US007052405B2

(12) United States Patent
Davis et al.

(10) Patent No.: US 7,052,405 B2
(45) Date of Patent: May 30, 2006

(54) BOWLING LANE CONSTRUCTION PROVIDING ADJUSTABLE LANE TOPOGRAPHY

(75) Inventors: John M. Davis, Sebring, FL (US); Mark E. Davis, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 0 days.

(21) Appl. No.: 10/864,103

(22) Filed: Jun. 9, 2004

(65) Prior Publication Data

US 2005/0277481 A1 Dec. 15, 2005

(51) Int. Cl.
*A63D 1/04* (2006.01)

(52) U.S. Cl. ..... 473/115

(58) Field of Classification Search ..... 473/54, 473/115, 116

See application file for complete search history.

(56) References Cited

U.S. PATENT DOCUMENTS 2,493,620 A * 1/1950 Cusano ..... 273/126 R
3,211,454 A * 10/1965 Bailey ..... 473/115
4,269,411 A 5/1981 Heddon
4,336,937 A 6/1982 Kelly
4,406,455 A 9/1983 Berry et al.
4,421,309 A 12/1983 Heddon
4,456,253 A 6/1984 Kelly
4,580,780 A 4/1986 Gautraud
4,779,868 A * 10/1988 Ayre, Jr. ..... 473/115
4,801,143 A 1/1989 Heddon
5,275,397 A 1/1994 Heddon
5,348,513 A 9/1994 Heddon
5,549,516 A 8/1996 Heddon

* cited by examiner

*Primary Examiner*—William M. Pierce
(74) *Attorney, Agent, or Firm*—Hovey Williams LLP

(57) ABSTRACT

The topography of a bowling lane may be adjusted after installation through the use of special truss assemblies beneath the lane that are provided with a height adjustment mechanism that is remotely actuatable at a convenient location. Lane tilt, including side-to-side tilt, may be adjusted through the use of upright, threaded members that raise or lower opposite ends of beams associated with the truss assemblies. Crowns and depressions can be adjusted by way of independently adjustable devices that raise or lower isolated portions of the lane relative to the beam of the truss assembly. Adjustment for crowns and depressions can be provided with or without the ability to adjust for lane tilt. In one embodiment, chains and sprockets associated with such adjustment mechanism can be manipulated from a convenient access opening off to one side of the lane and located below the lane surface, such access opening being covered by an easily removable cap.

8 Claims, 3 Drawing Sheets

BOWLING LANE CONSTRUCTION PROVIDING ADJUSTABLE LANE TOPOGRAPHY

TECHNICAL FIELD

This invention relates to bowling lanes and, more particularly, to a bowling lane constructed in such a manner that the topography of the lane may be readily adjusted to render the lane essentially perfectly level or to create regions of tilt, crowns or depressions.

BACKGROUND AND SUMMARY

In current bowling lane constructions, it is difficult to keep the lane surface perfectly level. Shims maybe used at appropriate locations to raise selected areas of the lane relative to others, but it is difficult once the lane has been constructed to gain access to such areas beneath the lane and it is time consuming and laborious to carry out such efforts. Accordingly, one important object of the present invention is to provide a bowling lane construction wherein the topography of the lane can be relatively quickly and easily adjusted both at the time of initial installation and at any and all times thereafter.

In carrying out the foregoing object, the present invention contemplates the use of multiple supporting truss assemblies beneath the bowling lane that are provided with height adjustment mechanisms operable to raise or lower selected portions of the lane. Preferably, such mechanisms are remotely actuatable from a convenient location. In this regard, one preferred embodiment of the present invention contemplates having remote actuators for the various adjustment devices located along the length of the lane in convenient areas such as under a capping structure adjacent the gutters so that, upon removal of the capping structure, the operator has immediate access to the actuators. One way of providing such remote manipulation of the adjustment mechanism is through an arrangement of chains and sprockets leading from bolt-type actuators to adjustment mechanisms associated with each truss assembly. Other forms of remote actuators may comprise various types of control devices connected electrically with motors associated with the adjustment mechanisms.

Upright members of the adjustment mechanism are shiftable upwardly or downwardly as a result of operating the remote actuators to cause consequential changes in the vertical position of selected lane portions. In a preferred embodiment, the lane may be adjusted for side-to-side tilt at various locations along its length. Another embodiment provides for the creation or reduction of crowns and depressions in the lane at specific locations, while a further embodiment combines both side-to-side tilt and crown/depression adjustment.

DETAILED DESCRIPTION

Figure 1:
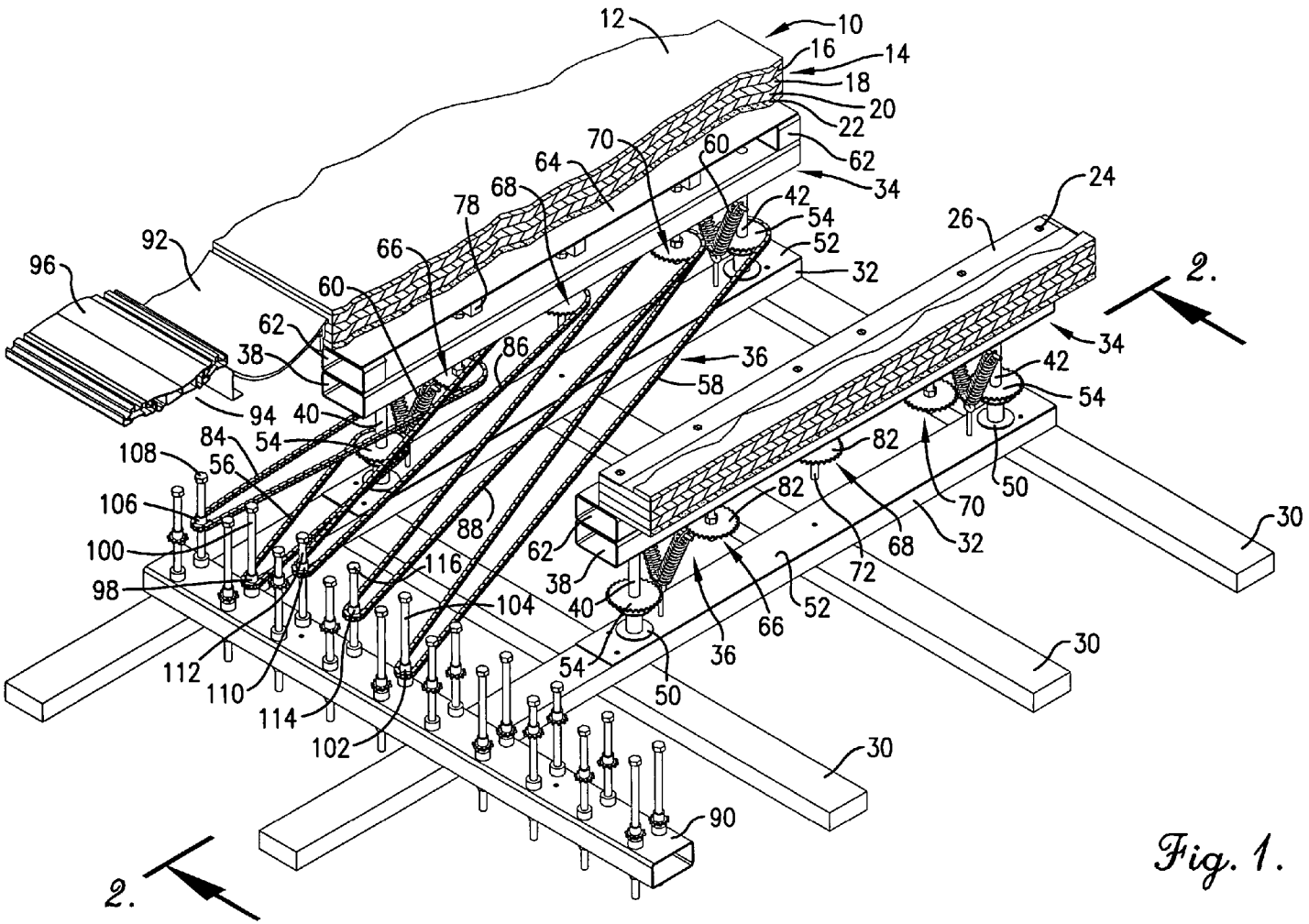
FIG. 1 is a fragmentary isometric view of a bowling lane construction incorporating the principles of the present invention.
Figure 2:
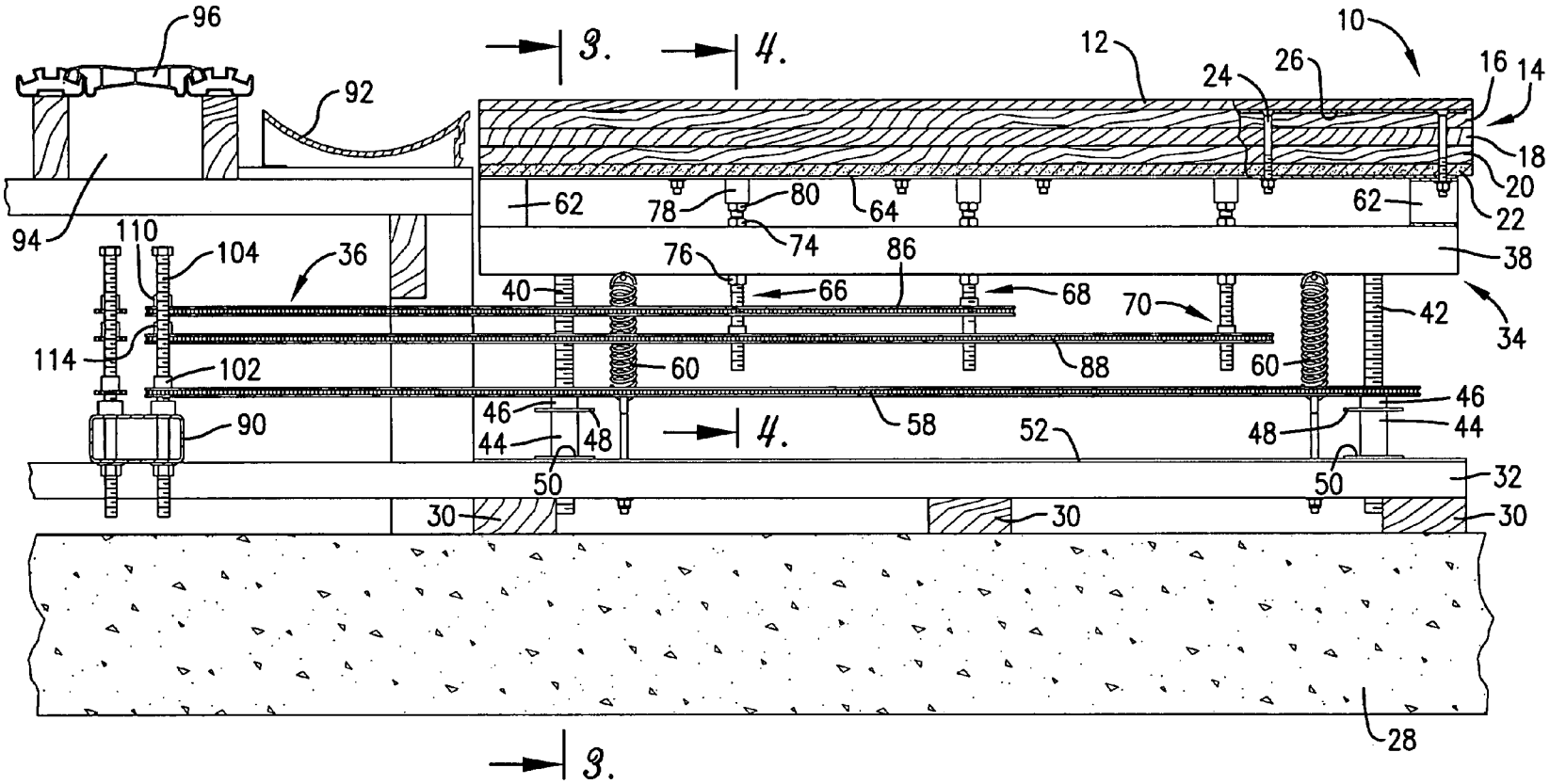
FIG. 2 is a fragmentary cross-sectional view thereof taken generally along sight line 2—2 of FIG. 1.
Figure 3:
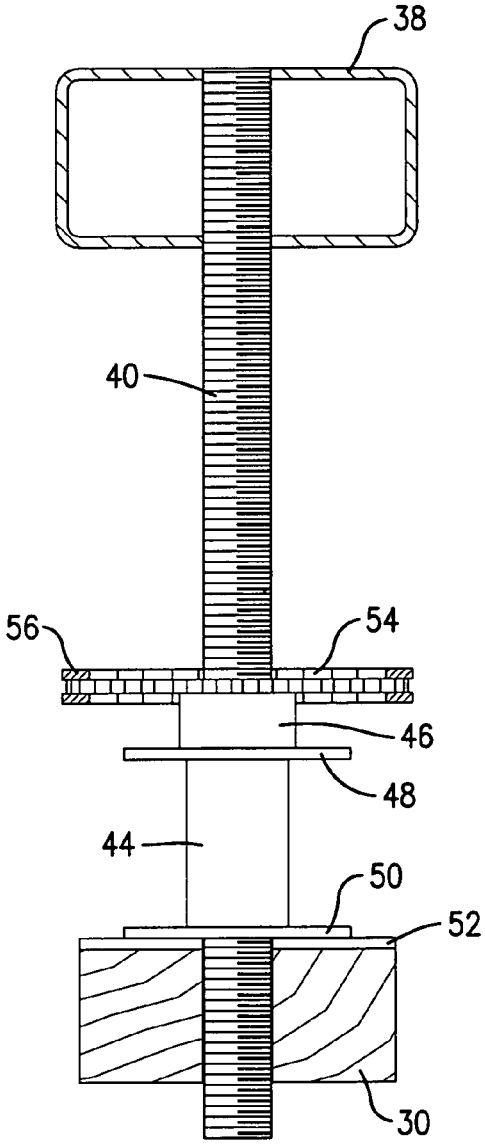
FIG. 3 is an enlarged cross-sectional view of one of the lane tilt adjusters of the bowling lane construction taken substantially along line 3—3 of FIG. 2.
Figure 4:
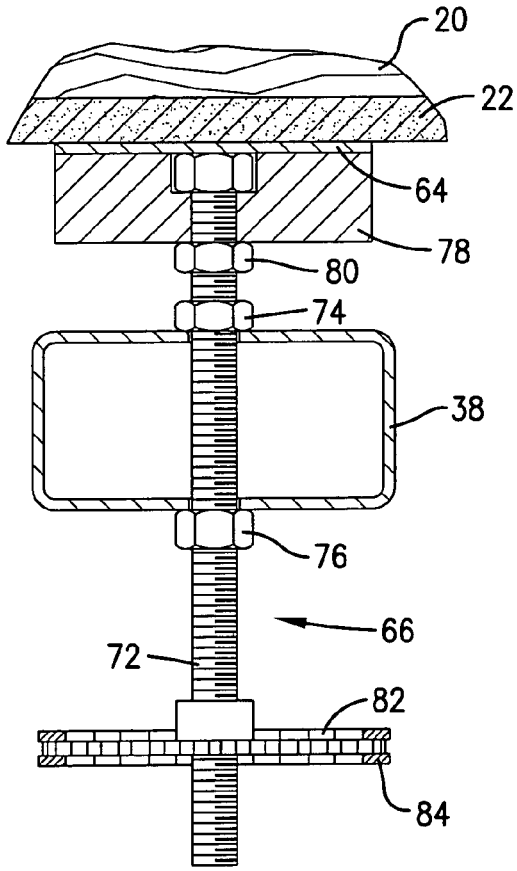
FIG. 4 is an enlarged, fragmentary cross-sectional view of one of the crown adjustment devices taken substantially along line 4—4 of FIG. 2.

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

The bowling lane 10 shown fragmentarily in the drawings is of composite construction, preferably including a top panel 12 of suitable synthetic material such as phenolic resin and a built-up underlayment 14 comprising multiple layers of materials. In one embodiment, underlayment 14 may comprise three layers 16, 18 and 20 of pressboard or the like, as well as a bottommost layer 22 of pressed paper product such as one-half inch CELOTEX. Top panel 12 may be secured to pressboard layer 16 by means well known to those skilled in the art, such as by screws (not shown) or adhesive. Pressboard layers 16, 18 and 20 are secured to the pressed paper layer 22 using bolts 24. A relatively narrow, thin metal strip 26 may be recessed into the top pressboard layer 16 of underlayment 14 for the purpose of providing a solid surface against which the heads of bolts 24 may be drawn down into engagement.

Lane 10 is supported by structure within a shallow pit beneath lane 10, such pit having a concrete floor 28. In one embodiment a series of preferably wooden runners 30 on floor 28 extend lengthwise of the lane and are disposed at equally laterally spaced locations across the width thereof. Wooden cross beams 32 extend transversely across the tops of runners 30 at longitudinally spaced locations along their length, each cross beam 32 being rigidly secured to the runners 30 by any suitable means. Each cross beam 32, in turn, carries a supporting truss assembly 34 that rises upwardly from the cross beam to engage and support the lane 10 from beneath. A height adjustment mechanism broadly denoted by the numeral 36 is operably associated with each truss assembly 34 for adjusting the topography of lane 10 by vertically adjusting selected portions thereof relative to other areas of the lane. Although only two truss assemblies 34 have been illustrated, it will be understood that thirty or more of such trusses are present along the length of the lane at approximately two-foot intervals.

Each truss assembly 34 includes a tubular beam 38 extending transversely of lane 10 across the full width thereof. Beam 38 is supported at its opposite ends by a pair of uprights 40 and 42 that are welded at their upper ends to beam 38. In a preferred embodiment the lower end of each upright 40, 42 is telescopically received within an upright, tubular spacer 44 and passes completely through such spacer and through the cross beam 32. Each upright 40,42 serves not only as a support for lane 10, but also as part of the height adjusting mechanism 36 by virtue of the fact that each upright 40, 42 is threaded along its entire length and is adjustably shiftable vertically to cause the corresponding end of beam 32 to move up or down. Threaded uprights 40,42 thus are adapted for adjusting the side-to-side tilt of lane 10.

In order to adjust the uprights 40, 42 up or down, height adjustment mechanism 36 further includes a nut 46 immediately above spacer 44 that threadably receives the corresponding upright 40 or 42. A washer 48 is located between the bottom of nut 46 and the top surface of spacer 44 to facilitate rotation of nut 46 relative to spacer 44. Another washer 50 is located at the bottom of spacer 44 between such surface and a metal mounting plate 52 fastened to the top surface of cross beam 32. When nut 46 is rotated, its corresponding upright 40 or 42 is displaced upwardly or downwardly, depending up the direction of rotation of nut 46. A sprocket 54 is welded to the top surface of nut 46. Sprocket 54 on upright 40 is entrained by a chain 56 so that nut 46 maybe rotated by remotely disposed actuation means, while the sprocket 54 on upright 42 is entrained by a chain 58 to permit remote manipulation of the nut 46 associated with upright 42. Two sets of hold down springs 60 adjacent opposite ends of beam 38 are anchored at their upper ends to beam 38 and at their lower ends to cross beam 32 so as to apply continuous downward pulling force on beam 38. Among other things, such constant down pressure by springs 60 keeps adjuster nuts 46 seated against the spacers 44 due to the downward thrust of uprights 40, 42.

Each truss assembly 34 further includes a pair of short, horizontal, tubular risers 62 welded to the top surface of beam 38 adjacent its opposite ends. A relatively thin metal plate 64 corresponding to the width of beam 38 is welded to the top surfaces of risers 62 and extends the full length of beam 38. At its weld points with risers 62, plate 64 is thus immovable relative to beam 38. However, in its central section between risers 62, plate 64 can be flexed slightly in an upward and downward direction so as to correspondingly raise or lower isolated portions of lane 10 to create crowns or depressions.

In order to effect such flexing of plate 64, a number of crown adjustment devices 66, 68 and 70 are provided as part of height adjustment mechanism 36. Such crown adjustment devices 66–70 have utility separate and apart from the lateral tilt adjustment mechanism for the lane and may be provided and utilized even though no lateral tilt adjustment mechanism is part of the lane construction.

In a preferred embodiment each of the crown adjustment devices 66, 68 and 70 includes an upright member 72 that is threaded along its entire length. Member 72 passes through beam 38 and is threadably received by a pair of nuts 74 and 76 welded to the upper and lower surfaces of beam 38 respectively. A support block 78 is mounted on the upper end of threaded member 72 in such a manner that block 78 bears against and is welded to the bottom surface of plate 64 but does not rotate when threaded member 72 is rotated. A jam nut 80 fixed to threaded member 72 immediately below block 78 assists in this respect.

Rotation of threaded member 72 thus causes it to move upwardly or downwardly relative to beam 38 as it threads through nuts 74 and 76, thereby raising or lowering block 78 to correspondingly flex the plate 64. Such motion thereby creates a crown or depression within lane 10, depending upon the extent of such linear movement of threaded member 72 and the direction of its rotation.

In order to effect such rotation, each of the uprights 72 is provided with its own sprocket 82 below beam 38. Sprocket 82 is fixedly secured to upright 72 by any suitable means so that when sprocket 82 is rotated, such rotation is transmitted to upright 72. In the case of adjustment device 66, a chain 84 is entrained around sprocket 82 for enabling sprocket 82 to be actuated remotely; in the case of adjustment device 68, a chain 86 is entrained about sprocket 82 for this purpose; and in the case of adjustment device 70, a chain 88 is entrained about sprocket 82 of the device to render the device remotely actuatable.

In one preferred form of the invention, the adjusting chains 56, 58, 84, 86 and 88 are rendered remotely actuatable by a series of upright adjusting bolts mounted on a mounting element 90 that extends parallel to lane 10 generally alongside the latter below a gutter 92 and an access opening 94 that runs the full length of the adjustable portion of lane 10. It is contemplated that such mounting element 90 will support an entire series of adjusting bolts not only for the entire adjustable length of lane 10, but also for the adjustable portion of the lane next adjacent lane 10. Thus, in the illustrated embodiment, two rows of adjusting bolts are illustrated on supporting element 90. Such bolts are accessible via the opening 94 when a cap 96 is removed therefrom.

As illustrated, chain 56 for tilt adjuster 40 is entrained around a sprocket 98 fixed in any suitable manner to a bolt 100 that is rotatably carried by mounting element 90. Likewise, the other tilt chain 58 is entrained around a sprocket 102 on a bolt 104 rotatably mounted on element 90. Chain 84 of crown adjustment device 66 is entrained around a sprocket 106 fixed to a bolt 108 rotatably supported by element 90. Intermediate crown adjustment device 68 has its chain 86 entrained around a sprocket 110 fixed to a bolt 112 that is rotatably supported by element 90. Crown adjustment device 70 has its chain 88 entrained around a sprocket 114 that is fixed to a bolt 116 rotatably supported by mounting element 90.

Operation

It should be apparent from the foregoing that adjustments in the topography of lane 10 can be relatively quickly and easily carried out by removing the cap 96 adjacent the area where adjustment is desired and applying a socket wrench or other suitable tool to the appropriate adjusting bolt alongside the lane. Suitable indicia or other method of quickly and easily identifying the appropriate bolt to be adjusted is preferably utilized with the bolts, although such is not shown in the drawings. If lane tilt is desired to be adjusted, either or both of the tilt bolts 100 and 104 is manipulated. Such manipulation causes the appropriate beam 38 to rise or fall at its opposite ends, depending upon the direction of manipulation of the tilt bolts and the extent of such manipulation. In this regard, it is anticipated that the range of adjustment may only be on the order of plus or minus forty thousandths of an inch, although other ranges are also available and within the principles of the present invention. Because the beam 38 as a whole is raised or lowered at one or both of its opposite ends, the lane 10 is likewise raised or lowered in the area-of selected truss assembly to control the tilt in that region.

If a crown or depression is desired, the appropriate crown adjustment bolt 108, 112, or 116 is manipulated in the appropriate direction and to the appropriate extent. Such manipulation causes the corresponding adjustment device 66, 68 or 70 to move upwardly or downwardly relative to the beam 38, flexing plate 64 slightly in the region of the particular adjustment device and causing corresponding crown or depression adjustment in the lane 10. Once again, the magnitude of such adjustment is on the order of plus or minus 0.040 inches.

It will be appreciated that by virtue of the adjustability as above described, playing surfaces can be obtained that are significantly more level than have heretofore been available. Correspondingly, non-level conditions can also be imparted to the playing surface in the event such condition is desired.

It will be further appreciated that numerous changes could be made in the disclosed embodiments without departing from the principles of the present invention. For example, instead of or in addition to lateral tilt, the lanes could be set up for longitudinal tilt adjustment along the length of the lanes. Further, tilt adjustment alone could be provided without adjustments for crowns or depressions. Conversely, adjustments for crowns or depressions could be provided without provision for tilt adjustment. Additionally, a variety of different kinds of remote adjusters could be provided for tilt and/or crown and depression adjustment. For example, instead of the chains and sprockets and remote bolt-type actuators, electric motors could be coupled directly to the shafts of the various adjustment devices and controlled remotely using programmable logic controllers and associated indicator devices.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

What claimed is:

1. A bowling lane construction comprising:

an elongated bowling lane; and support structure supporting the lane from beneath the same, said support structure having height adjustment mechanism operably associated therewith for selectively raising and lowering certain portions of the lane relative to other portions of the lane, said structure including a plurality of support assemblies beneath the lane, each of said support assemblies including a support beam extending transversely of the lane, said mechanism including lateral lane tilt apparatus operably coupled with the beam for adjusting the height of one end of the beam relative to the other, each of said support lane assemblies further including a pair of beam-supporting uprights adjacent opposite ends of the beam, said lane tilt apparatus including a rotatable adjuster for each upright operable when rotated to raise or lower the corresponding upright, each adjuster being threadably coupled with the corresponding upright, said tilt apparatus further including an actuating assembly operably coupled with each adjuster and including an actuator positioned remotely from the adjuster for operating the adjuster from a remote location, each adjuster including a sprocket, said actuating assembly further including an actuating sprocket on said actuator, an adjusting sprocket on said adjuster, and a chain operably entraining said sprockets for causing the adjusting sprocket to rotate when the actuator is rotated.

2. A bowling lane construction comprising:

an elongated bowling lane; and support structure supporting the lane from beneath the same, said support structure having height adjustment mechanism operably associated therewith for selectively raising and lowering certain portions of the lane relative to other portions of the lane, said height adjustment mechanism including least one crown adjustment device spaced inwardly from a side margin of the lane for adjusting an inboard portion of the lane relative to side margin portions thereof, said structure including a plurality of support assemblies beneath the lane, each of said support assemblies including a lane-supporting beam extending transversely of the lane and a flexible support plate spaced above said beam, said crown adjustment device being located between the beam and the plate for slightly flexing the plate relative to the beam upon operation of the device to effect said adjusting of an inboard portion of the lane, said crown adjustment device including an upright member threadably coupled with said beam for vertical adjusting movement in response to rotation thereof, said height adjustment mechanism further including an actuator spaced remotely from said crown adjustment device for operating the crown adjustment device from a remote location, said crown adjustment device and said remote actuator being operably interconnected by a chain and sprocket assembly.

3. A bowling lane construction as claimed in claim 2, said mechanism including lateral lane tilt apparatus operably coupled with the beam for adjusting the height of one end of the beam relative to the other.

4. A bowling lane construction as claimed in claim 3, said lane tilt apparatus being operably coupled with a remote actuator for operation of the lane tilt apparatus remotely.

5. A bowline lane construction comprising:

an elongated bowling lane; and support structure supporting the lane from beneath the same, said support structure having height adjustment mechanism operably associated therewith for selectively raising and lowering certain portions of the lane relative to other portions of the lane, said height adjustment mechanism being operable remotely from said structure, said height adjustment mechanism including rotatable elements adjacent the support assembly, rotatable actuators remote from said support assembly, and chain and sprocket assemblies operably interconnecting said actuators and said elements.

6. A bowling lane construction as claimed in claim 5, said height adjustment mechanism including at least one crown adjustment device spaced inwardly from a side margin of the lane for adjusting an inboard portion of the lane relative to side margin portions thereof.

7. A bowling lane construction as claimed in claim 5, said height adjustment mechanism including lateral lane tilt apparatus for adjusting the tilt of the lane in a transverse direction.

8. A bowling lane construction as claimed in claim 7, said height adjustment mechanism further including at least one crown adjustment device spaced inwardly from a side margin of the lane for adjusting an inboard portion of the lane relative to side margin portions thereof.

* * * * *